US006374882B1

(12) United States Patent
McLoughlin

(10) Patent No.: US 6,374,882 B1
(45) **Date of Patent: *Apr. 23, 2002**

(54) FAIRWAY/DRIVER-WOODS/METAL PROTECTIVE COVERS

(76) Inventor: Janelle Crain McLoughlin, 2415 Riverside Dr., Santa Ana, CA (US) 92706

( * ) Notice: Subject to any disclaimer, the term of this patent is extended or adjusted under 35 U.S.C. 154(b) by 51 days.

This patent is subject to a terminal disclaimer.

(21) Appl. No.: 09/634,527

(22) Filed: Aug. 8, 2000

(51) Int. Cl.[7] ..... A63B 55/00
(52) U.S. Cl. ..... 150/160
(58) Field of Search ..... 150/159, 160; 206/315.2

(56) References Cited

U.S. PATENT DOCUMENTS 1,886,464 A * 11/1932 Bright ..... 150/160
3,145,749 A * 8/1964 Rosenow ..... 150/160
3,821,976 A * 7/1974 Smith et al. ..... 150/160
5,738,157 A * 4/1998 Gaffney ..... 150/160
RE35,899 E * 9/1998 Cirone ..... 150/160
D445,864 S * 6/2001 McLoughlin ..... D21/754

* cited by examiner

*Primary Examiner*—Lee Young
*Assistant Examiner*—Tri M. Mai
(74) *Attorney, Agent, or Firm*—Frank A. Lukasik

(57) ABSTRACT

A cover for the head of a fairway/driver-wood golf club consisting of a cover panel having an outer edge generally shaped to match the shape of a golf club head, made of a polychloroprene material and a main panel being formed from a single sheet of stretchable material, the two panels being glued together and stitched together using a blind stitch. A golf club cavity is formed on one end and an inverted "V" opening on the other end.

7 Claims, 5 Drawing Sheets

FAIRWAY/DRIVER-WOODS/METAL PROTECTIVE COVERS

BACKGROUND OF THE INVENTION

1. Field of the Invention

The invention relates generally to golf club covers and more particularly relates to golf club head covers for fairway/driver-woods clubs.

2. Description of the Prior Art

It is well known to cover wood and iron golf club heads including adjacent shank portions, with various types of covers made from various types of material to protect the club head against damage and deterioration. Typically, such golf club headcovers are made from the following various types of materials: knitted or woven textile materials including slip-on sox-type covers, semi-flexible material such as leather, nylon and the like and even more flexible materials such as slip-on or hinge-type molded plastic headcovers. The slip-on molded plastic covers are generally provided with closed slotted side walls which open to permit insertion of a golf club in the headcover itself. The hinge-type molded plastic covers have two mating half sections formed in the general shape of a golf club head, with an integral hinge extending therebetween and snap fastener means for securing the two halves to one another for containing a golf club head therein.

All of the foregoing have been used quite effectively in protecting both wood head and iron head golf clubs from damage and deterioration, and yet, they all have many of the same inherent disadvantages. One of the problems is that the prior art golf club headcovers are not built to last. Particularly in the case of knitted or woven textile materials and semi-flexible materials, they have a tendency to tear or come apart or crack during heavy use. While the slip-on and hinge-type molded plastic cover discussed above are more durable and long lasting, they have been used only on iron head golf clubs. Thus there has been a long felt need for a durable and long lasting headcover which is capable for use with fairway/driver woods/metal protective covers.

Protective devices for golf club heads have been described. U.S. Pat. No. RE 35,899 to Cirone discloses a golf club cover for iron golf clubs formed of an elastic, rubber material such as neoprene. The set of iron covers has one size and such that a snug fit with any of the irons of a set of golf clubs is ensured. U.S. Pat. No. 4,605,050 to Suk discloses a one size fits all golf club cover for woods which has a transparent insert for viewing the number of the golf club.

U.S. Pat. No. 5,117,884 to Diener et al discloses a molded golf club headcover which includes a headcover for substantially surrounding the golf club head and an integral skirt section extending from the golf club headcover. The integral skirt section is formed with a flexible and resilient circumferential wall that is configured, arranged and dimensioned to deform and then return to its original shape upon the insertion and removal of a golf club headcover to a golf club head when assembled. U.S. Pat. No. 5,611,379 to Hoyt et al discloses an enlarged iron cover which fits over the head of irons of different sizes. The cover section includes an internal cavity with an enlarged open mouth through which the head passes upon placing the cover section over the head and a protector section which covers at least partially the hosel members of the shaft when the head is received within the cavity.

U.S. Pat. No. 5,738,157 to Gaffney discloses a head cover having a closed upper end and an open lower end. The shaft protector has closure elements for closing the shaft protector around a shaft of a golf club.

U.S. Pat. No. 5,941,293 to Serpa discloses a golf club cover that includes an uncovered aperture for viewing the club head identification markings.

U.S. Pat. No. 5,944,081 to Aldcrof et al discloses an enlarged cover section which fits over the head of irons of different sizes. The cover has an enlarged open mouth through which the head passes and a protector section which partially covers the hosel member of the shaft.

U.S. Pat. No. 6,065,516 to Chang discloses a molded head sheath comprising a head-collaring portion in the shape of a club head and a sleeve-collaring portion in shape of a king pipe with a downward opening. Two outward expanded guide strips are provided at the sleeve-collaring portion.

Presently on the market, several golf club headcovers are offered: polyester fur and fabric combination, often with foam padding and knitted materials attached to protect the shaft of the club; cylindrical shaped covers in suede (and synthetic equivalents), with foam padding, and knitted materials attached to protect the shaft of the club; covers constructed of heavy knitted materials entirely; covers that are constructed of non-elastic woven materials with padding; and covers that are constructed of non-elastic woven materials combined with rubber (or other elastic materials) that stretch in isolated places.

Additionally, identification of clubs while covered was considered a drawback to previous club covers. Another patent holder designed a series of tags to be clipped onto the covers in order to more easily identify the clubs, however, that required maintenance, removal and re-application of the tags, as the club, the cover was utilized for, changed. Other patents contemplated see-through windows on the covers which allowed the user to see the actual head of the club. These windows were less protective than the surrounding material, and often obscured with age and/or use. The club covers described herein, are unique in that numbers assigned to the covers (clubs), on the labels, will never need to be replaced. Due to the extreme elasticity of the material utilized in the manufacture of the instant covers, the covers will stretch to accommodate the largest of the fairway woods or metals heads.

SUMMARY OF THE INVENTION

The present invention relates to golf club covers for fairway/driver-woods. The invention is designed to provide coverage for a variety of golf clubs, generally known as "wood driver", "metal driver", "fairway woods", and "fairway metals". These clubs are generally numbered 1 (driver), 2, 3, 4, 5, 6, 7, 8, 9, 10, and 11. These clubs, as the names suggest, may be made out of wood or metal. Any reference to "clubs" in this application refers to the clubs described directly above.

Equipment and accessories for the sport of golf, specifically fairway drivers and woods are notoriously expensive and can be difficult to maintain. The combination of short irons, and tall woods in a golf bag, allows the clubs to knock together and with objects outside of the golf bag. These collisions result in dents, chips and nicks on both the head and the shaft of the golf clubs. These defects affect the performance of the clubs.

For the above reason, covers for the golf club heads and shafts have been developed, however, none of the prior golf club head covers accomplished the following goals: removal and application with one free hand; construction with 100% rubberized materials that are stretchable for maximum contouring, and reduction of cover bulkiness, providing more room in the golf bag; construction with 100% neoprene, offering high performance and resistance to compression, in that the padding does not lose thickness through repeated usage; shaped and sized to fit each club, to reduce bulkiness, encourage nesting, and distinguishes club size and simplifies identification of each club; protection of the shaft with the neoprene padding, designed to brush the opening edge of the golf bag, and prevent crowding by the neoprene shaft covering into the bag itself; providing enough stretch in the construction material of the covers, to provide one size per club regardless of the maker or design of the club; constructed with materials that allow the cover to be folded and placed into a pant or golf bag pocket, and still return into the original design shape. The design of the covers captures the unique qualities of the component material (neoprene) and the advantages of a longer, more fitting club cover. Further, the design focuses on specific problems of application and versatility to make these covers easy to apply to the club, and versatile, due to their extensive stretch.

DETAILED DESCRIPTION OF THE PREFERRED EMBODIMENT

Figure 1:
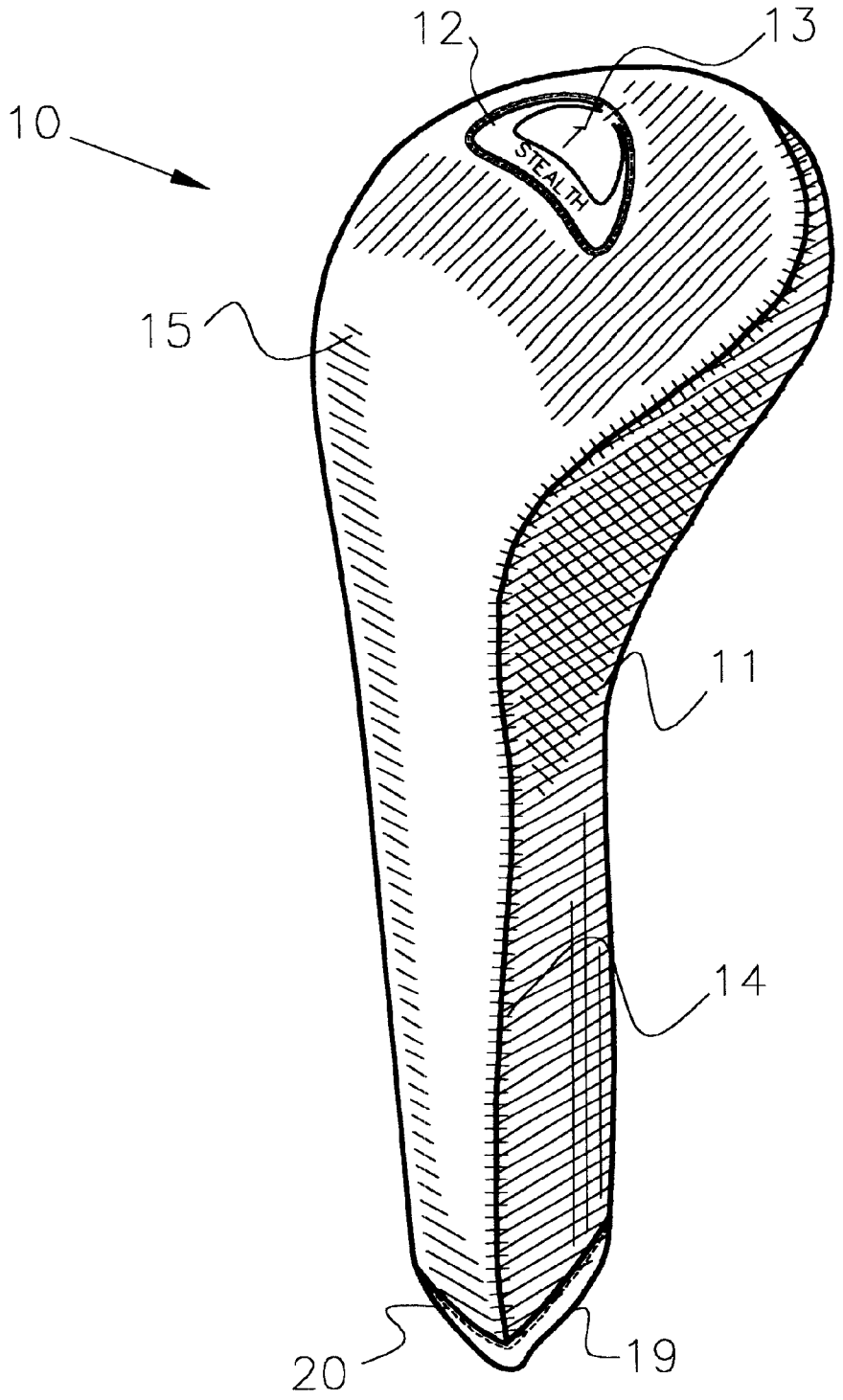
FIG. 1 is a top, front, isometric view of a golf club head cover in accordance with the invention.
Figure 3:
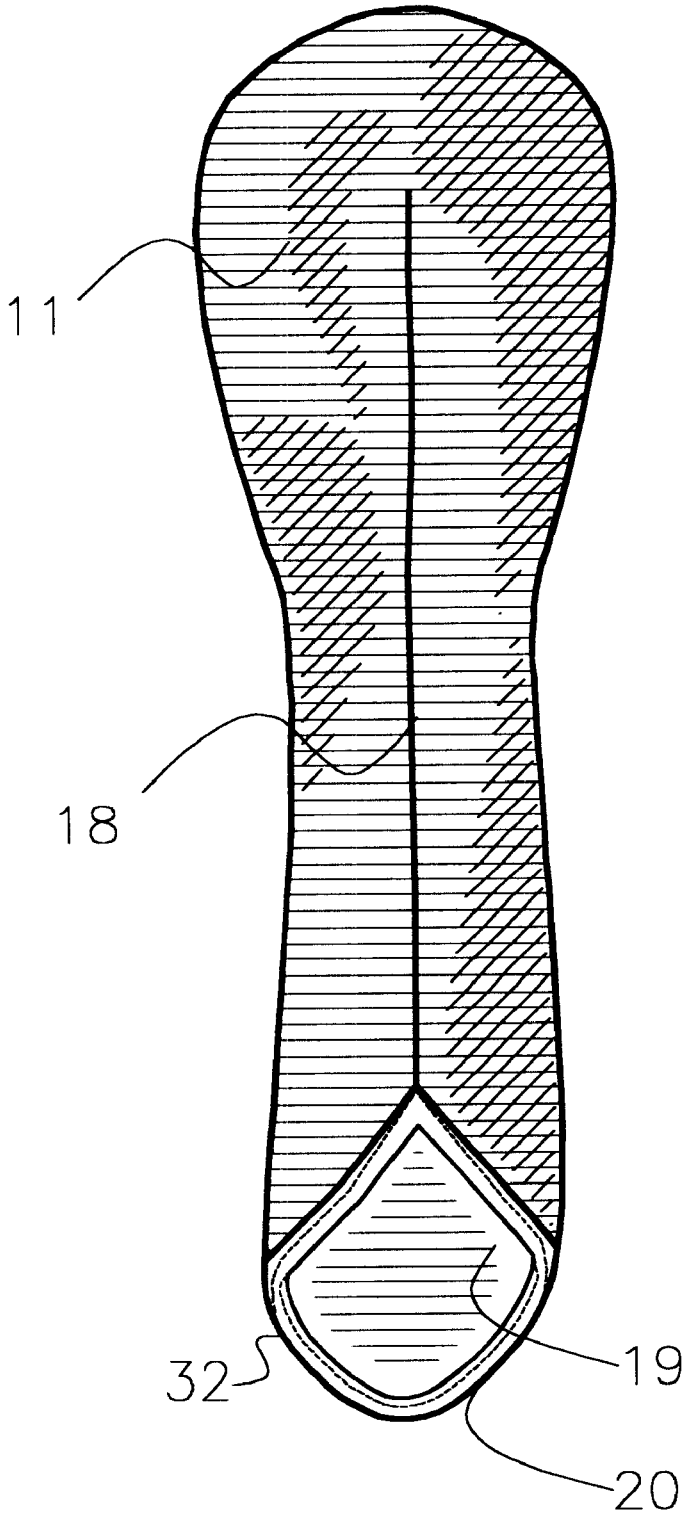
FIG. 3 is a bottom view of a golf club head cover in accordance with the invention.

Referring now to the drawings, wherein like numerals designate like and corresponding parts throughout the several views, the overall invention is designated by the numeral 10. In FIG. 1 there is an isometric view of a golf club head cover 10 showing a label 12 having a number 13 formed thereon designating the club as a #1 wood (driver). A label 12 is borne on each of the club head covers 10. This label 12 designates the number of the club, and is permanently attached to the material of the club head cover 12. The cover 10 is constructed from two principal sections. The main panel 11 is attached to cover panel 15. The cover panel 15 is generally shaped to match the shape of the club head. The edges of the two panels 11 and 15 are first glued together, and then subsequently stitched using a blind stitch 14. A blind stitch is defined as having no bobbin thread utilized so that there are no threads inside to scratch the club head or hinder easy entry of the club head. An elastic tape material 20 defines an opening 19 (FIG. 3). This elastic material 20, a nylon-spandex knit combination, seals the open rubberized edges of panels 11 and 15 and aids in helping the club head to glide into the head cover 10.

Figure 2:
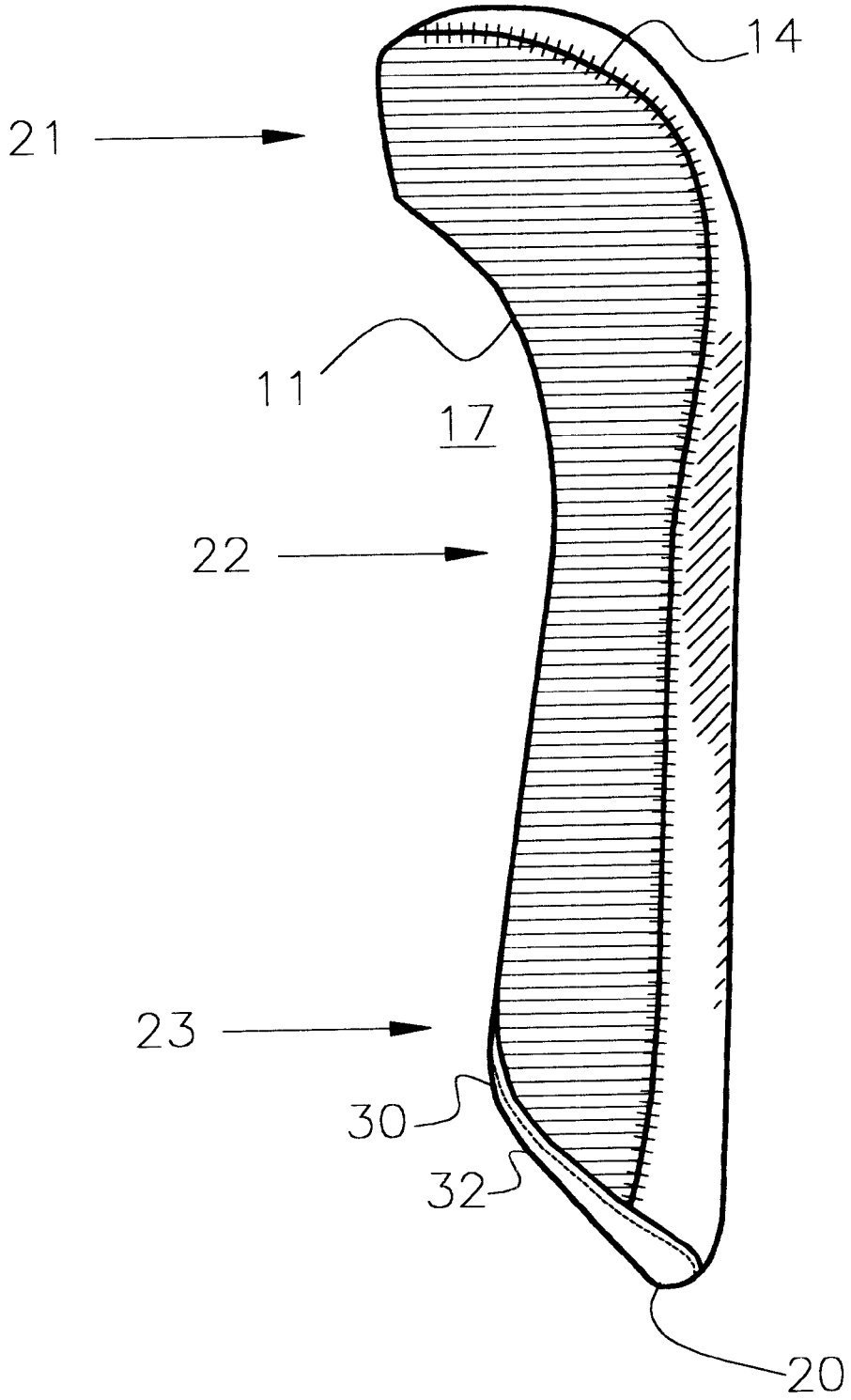
FIG. 2 is a side, isometric view of a golf club head cover in accordance with the invention.
Figure 4:
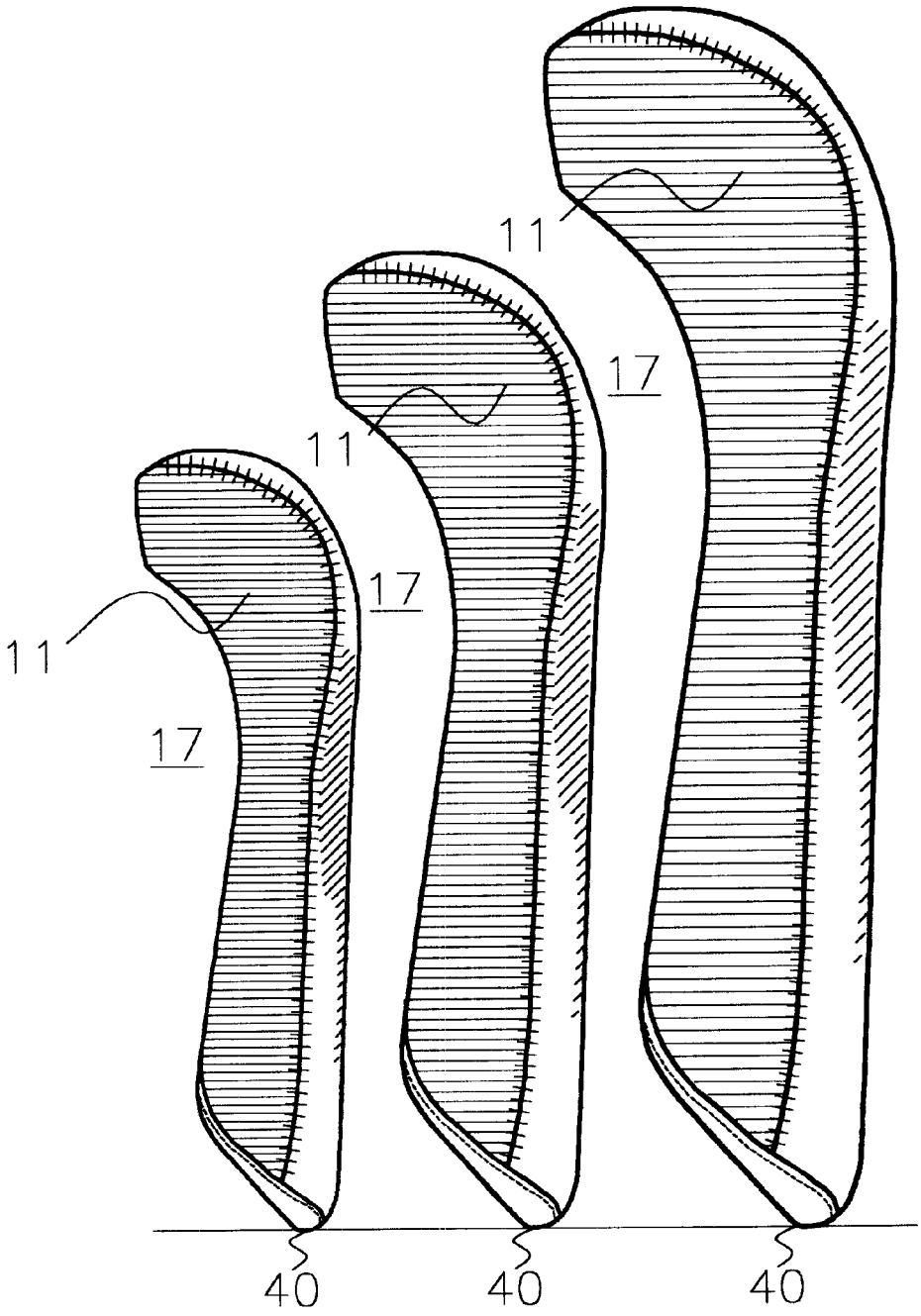
FIG. 4 is an isometric, side view of three, different sized golf club head covers in accordance with the invention.
Figure 5:
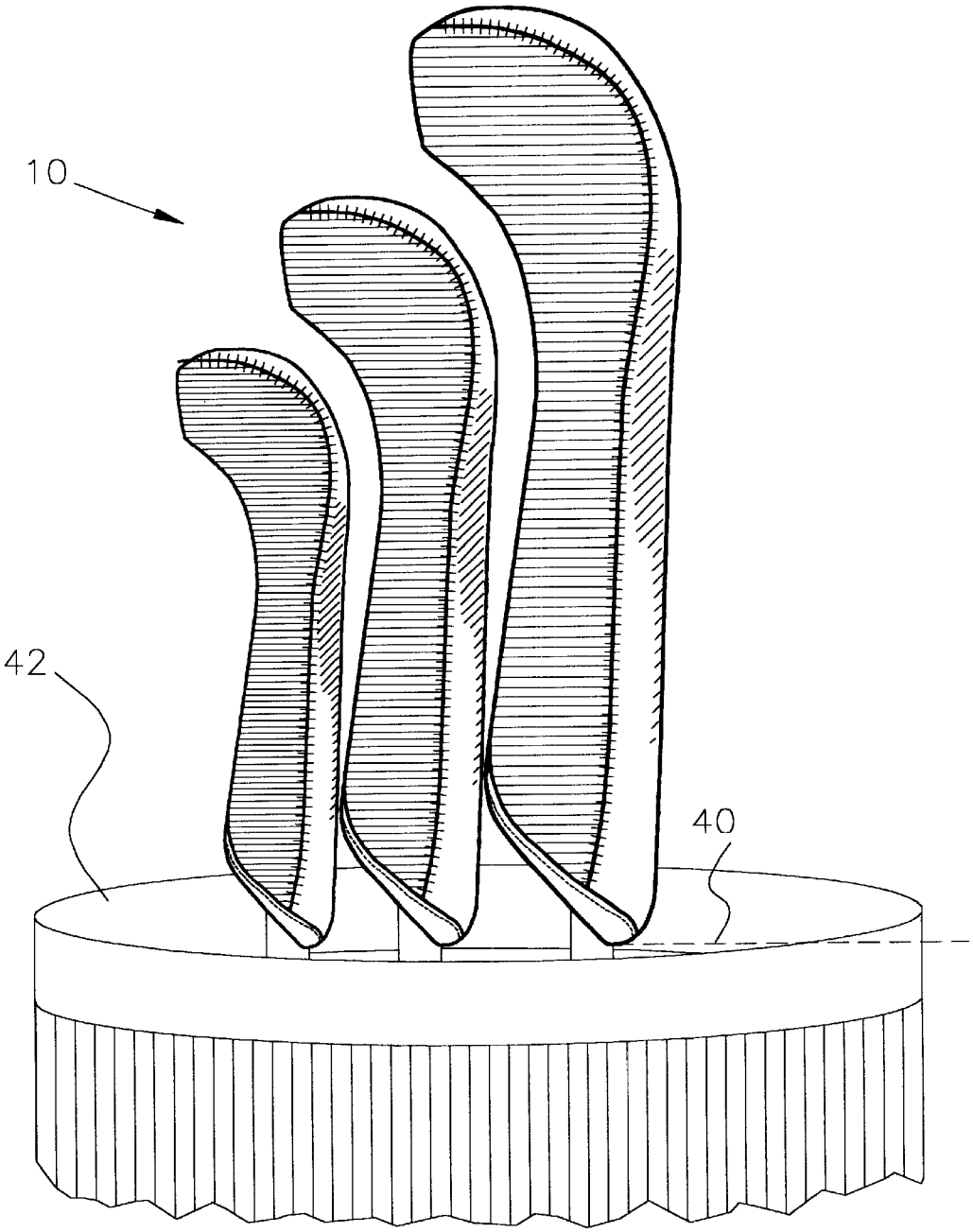
FIG. 5 is a top perspective view of a set of covered golf clubs in a golf bag.

In FIG. 2, the curved portion indicated by the numeral 17 of main panel 11, which is the specific curve design, and forms a shape roughly approximating that of a golf club head and hosel connection. FIGS. 4 and 5 are views of three different sized club covers 10 shown together as they are designed to "nest" close to each other. They all extend to their lowest point 40, below the bag top 42 showing that they can be close to each other and still reach the same distance down into a golf bag thereby protecting the shafts from rubbing damage. The length of the cover 10, in relation to the space provided for the actual head of the club, demonstrates the protection of the shaft contemplated by the design of the club cover 10. The tapered angle 30, extends from the end of the reverse "V" 32 to the edge of bag top 42. The angled edge of the design allows the cover 10 to protect the shaft, while not crowding the inside of the golf bag itself.

FIG. 3 is a bottom view of the club head cover 10 showing the special shape of the main panel 11. The panel 11 is formed from a single sheet cut in the shape of a "U" with the inside edges of the "U" sewn together as seam 18. The contraction of the "U" at the center provides the curved portion 17 discussed above. The central seam 18 in the bottom of the club cover is clearly visible from this angle. The unique, reverse "V"shape of the opening 19 in the club cover 10 is clearly shown. Furthermore, the shape of the panel 11 provides a large top portion 21, a narrow middle portion 22, and a medium bottom portion 23. The large top portion 21 is shaped to fit the club head size designated on club number 13. The narrow middle portion 22 is sized to stretch sufficiently to pass the club head during insertion, but sized to retract sufficiently to resist falling off when the club is taken out of the bag. The medium bottom portion 23 is sized to easily accept the insertion of the club head when the cover 10 is replaced and along with the tapered angle 30 is sized to provide more free space between the clubs.

In FIG. 3, reversed "V" 32 and opening 19 are clearly seen. Seam 18 is joined using a single needle stitch. Opening 19 allows the user to "hook" the cover over the end of the club and secure it in place by merely pulling gently downward.

The construction of the club head cover 10 relates directly to some of the functional benefits of the covers. In a preferred embodiment, the material used is an elastic rubber or synthetic rubber. This may or may not be laminated on one or both sides with a knitted fabric, novelty surface or flat surface material. Laminated is a term used to describe fabrics which have been joined together in a permanent bond either with foam, or some other material, by use of adhesives, the foam itself, heat, or chemical bonding agents. Often the fabric is bonded directly to the foam in the foam-fabric package.

The thickness contemplated by this product design is material measuring 3 mil, or ⅛ of an inch, though other thicknesses, between 0.5 mil and 5 mil will achieve the desired effect. This material is often called Neoprene of Dow Chemicals, Inc. Neoprene is preferred for its qualities of elasticity and water resistance. In the trade, Neoprene sheets are referred to as CR or Chloroprene Rubber, a manufactured fiber in which the fiber-forming substance is a polychloroprene or a copolymer of chloroprene in which at least 35% by weight of the fiberforming substance is composed of chloroprene units. Trade names include: Latex, Lactron, Revere (Uniroyal); Darleen (Darlington). Additionally, items such as CS, Chloroprene Rubber combined with Styrene Butidene Rubber (SBR) in a 70/30 mix respectively, may be utilized as well.

A manufactured fiber in which the fiber-forming substance is a hydrocarbon such as natural rubber, polyisoprene, polybutadiene, copolymers of dienes and hydrocarbons, or amorphous (non-crystalline) polyolefins may also be used. In this case, the hydrocarbon is styrene, a colorless aromatic hydrocarbon C8H8, contained in liquid storax, and also obtainable from cinnamic acid. A polymerized form is used in making plastics. Further, SBR, or the above mention Styrene Butidine Rubber, may be appropriate for manufacturing the head cover 10 as well.

CR generally is water resistant, in that the rubber component of the material does not absorb water like other materials (e.g. cotton). Because the Neoprene is resistant to absorbing water, the drying time is significantly reduced if the covers become wet prior to application, or while protecting the clubs. The elasticity of the product is unaffected by the wet or dry state of the material, and further, the wetness that is present will not cause the cover 10 to stretch or lose shape.

CR is also notable for its four way stretch characteristics, meaning that the material retains elasticity in all directions. Though the addition of the SBR reduces the elasticity to some degree, the shape and size of the cover 10 compensates for this feature. The entire product (except the label) is constructed from the CR, CS, SBR or other commercial equivalent. In addition to the material used in the instant invention, the particular design (the reverse "V" aperture 19), construction (stitching and shape), and material (100% neoprene or commercial equivalent) provide new and unexpected results and a superior golf club cover 10. "Neoprene" as used in the apparel industry, generally means any rubberized elastic material and is understood to be a trademark of Dow Chemicals, Inc., for their specific brand name of chloroprene rubber. This application utilizes the terms "neoprene" and "chloroprene rubber" interchangeably, unless otherwise noted.

As discussed above, the material utilized in the instant invention, in combination with the unique design features, makes application and removal of the covers 10 easier than was possible with state of the art covers. Further, the material utilized, reduces the damage caused by exposure to inclement weather (rain). Other materials become waterlogged, and lose their shape or elasticity.

The foregoing is a description of the preferred embodiments of the present invention. Various modifications and improvements will be readily apparent to one of ordinary skill in the art. The invention is not limited to the preferred embodiments, and is only limited by the claims appended hereto.

What is claimed is:

1. A cover for the head of a fairway/driver-wood golf club, comprising:

a cover panel having an outer edge generally shaped to match the shape of a golf club head, said cover panel being made of a stretchable material sufficiently long for covering a portion of the club head and a length of golf club shaft, a main panel being formed from a single sheet of stretchable material, said main panel having a first edge and a second edge, a first end and a second end, said first edge being cut in the shape of a "U" from a point near said first end, to a point near said second end, said first edge being folded together and joined together using single needle stitching, said second end being formed at an angle, said cover panel outer edge and said main panel second edge being glued together and stitched together using a blind stitch thereby forming a golf club shaped cavity at said main panel first end and a reverse "V" opening at said main panel second end, a label being attached to said cover panel, and an elastic tape being stitched to said cover panel outer edge and said main panel outer edge around said reverse "V", thereby sealing said outer edges and aiding in helping the club to slide into said cover.

2. The cover of claim 1, wherein said stretchable material is a manufactured fiber in which the fiber-forming substance is a polychloroprene in which at least 35% by weight of the fiber-forming substance is composed of Chloroprene units.

3. The cover of claim 1, wherein said stretchable material is Chloroprene Rubber combined with Styrene Butidene Rubber in a 70/30 mix respectively.

4. The cover of claim 1, wherein said stretchable material is a manufactured fiber from the group of hydrocarbons including natural rubber, polyisoprene, polybutadiene, copolymers of dienes and hydrocarbons, or amorphous polyolefins.

5. The cover of claim 1, wherein the thickness of said stretchable material is in a range between 0.5 mils and 5 mils.

6. The cover of claim 5 wherein the thickness of said stretchable material is 3 mils.

7. A cover for the head of a fairway/driver-wood golf club, comprising, a cover panel having an outer edge generally shaped to match the shape of a golf club head, said cover panel being in a range between 0.5 mils and 5 mils thick, manufactured, stretchable, fiber material in which the fiber-forming substance is a polychloroprene in which at least 35% by weight of the fiber-forming substance is composed of Chloroprene units, said fiber material being sufficiently long for covering a portion of the club head and a length of golf club shaft, a main panel being formed from a single sheet of said stretchable material, said main panel having a first edge and a second edge, a first end and a second end, said first edge being cut in the shape of a "U", from a point near said first end, to a point near said second end, said first edge being folded together and joined together using single needle stitching, said second end being formed at an angle, said cover panel outer edge and said main panel second edge being glued together and stitched together using a blind stitch thereby forming a golf club shaped cavity at said main panel first end and a reverse "V" opening at said main panel second end, a label being attached to said cover panel, and an elastic tape being stitched to said cover panel outer edge and said main panel outer edge around said reverse "V", thereby sealing said outer edges and aiding in helping the club to slide into said cover.

* * * * *